US005820577A

United States Patent [19]

Taylor

[11] Patent Number: 5,820,577

[45] Date of Patent: Oct. 13, 1998

[54] FINGER EXERCISE DEVICE

[76] Inventor: Terrence M. Taylor, 710 Cascade Rd., Pittsburgh, Pa. 15221

[21] Appl. No.: 937,623

[22] Filed: Sep. 26, 1997

Related U.S. Application Data

[60] Provisional application No. 60/027,439 filed Sep. 26, 1996.

[51] Int. Cl.[6] ..... A63B 23/16

[52] U.S. Cl. ..... 601/40; 482/47; 602/22

[58] Field of Search ..... 601/40; 602/21, 602/22, 31; 482/47, 48

[56] References Cited

U.S. PATENT DOCUMENTS

| | | | |
|---|---|---|---|
| 494,197 | 3/1893 | Hall | 601/40 X |
| 2,353,129 | 7/1944 | De Mona | 601/40 |
| 4,602,620 | 7/1986 | Marx . | |
| 4,644,938 | 2/1987 | Yates et al. . | |
| 4,765,320 | 8/1988 | Lindemann et al. . | |
| 4,809,688 | 3/1989 | Aymerica del Valle et al. . | |
| 4,875,469 | 10/1989 | Brook et al. | 601/40 |
| 4,945,902 | 8/1990 | Dorer et al. | 601/40 X |
| 4,949,711 | 8/1990 | Gyovai et al. . | |
| 5,115,806 | 5/1992 | Greuloch et al. | 601/40 |
| 5,261,393 | 11/1993 | Weinzweig | 601/40 |
| 5,348,531 | 9/1994 | Brown et al. | 601/40 X |
| 5,413,554 | 5/1995 | Trueman . | |
| 5,447,490 | 9/1995 | Fula et al. | 601/40 |

*Primary Examiner*—Linda C. Dvorak

*Attorney, Agent, or Firm*—Webb Ziesenheim Bruening Logsdon Orkin & Hanson, P.C.

[57] ABSTRACT

A finger exercise device that includes a splint adapted to receive a hand and a portion of a forearm and a plurality of individual finger pulley arrangements adapted to be secured to a plurality of fingers of a patient. Each of the pulley arrangements includes a hook adapted to be glued to a fingernail of a patient's finger, a connector secured to the hook, an elastically extendable member secured to the connector, a pulley strap coacting with the elastically extendable member, the pulley strap adapted to be secured to the patient's finger, and a pin securing the elastically extendable member to the splint. The splint includes a plurality of segments for supporting the patient's forearm and hand.

13 Claims, 3 Drawing Sheets

FINGER EXERCISE DEVICE

CROSS REFERENCE TO RELATED APPLICATION

This application claims the benefit of U.S. Provisional Pat. application Ser. No. 60/027,439, filed Sep. 26, 1996 entitled "Pulley Strap Traction Guides".

BACKGROUND OF THE INVENTION

1. Field of the Invention

The present invention relates to splints, and more particularly, hand splints and finger exercisers.

2. Description of the Prior Art

Great achievements have occurred in the field of medicine during the twentieth century, from the discovery of antibiotics to medical procedures, such as transplants. These achievements not only apply to antibiotics and medical procedures, but also apply to how the patient is treated in and out of the hospital, particularly in the field of outpatient therapy, such as physical therapy and occupational therapy.

Such therapy in its most basic early form was little more than hand holding. However, occupational therapy and physical therapy have made great strides since those early days. Today, insurance carriers are paying for fewer overnight hospital stays by requiring many medical procedures to take place on an outpatient basis and the insurance carriers are approving less frequent therapy visits. In this environment, therapy has taken on an active role in a patient's treatment. Much of the patient's care is done by the patient alone through an individualized home program exercise regimen.

In the case where patients have sustained damage to their fingers or have had surgery on their fingers, an exercise type of hand or occupational therapy may be prescribed. This therapy can include placing the hand in a splint and securing a tension member to the splint and the damaged finger, such as described in U.S. Pat. No. 5,413,554.

U.S. Pat. No. 5,413,554 discloses a hand splint and exerciser having a two-sectioned splint and an elastic band secured to a patient's finger through two adjustable straps, one on the distal phalanx and one on the proximal phalanx. The adjustable straps include hook and loop VELCRO®-type fasteners. The adjustable strap at the distal phalanx must be wrapped tightly around the finger so that the strap will not slip or move around during flexing of the finger resulting in improper exercising of the finger. If tightly wrapped, the strap may limit blood supply to the fingertip thereby damaging the finger tissue. The two-sectioned splint enables the patient's metacarpal phalangeal joints of the fingers to be extended at 90° from the palm of the hand. The elastic band is guided by a series of guides or metal loops positioned along a length of the splint. This arrangement adds friction and reduces gliding which unduly constrains the movement of the fingers undergoing therapy and is believed to hinder rehabilitation of the fingers that have sustained certain types of injury. Furthermore, this arrangement applies to a single digit or only to those fingers which are injured.

Therefore, the objectives of the present invention are to provide a hand splint and exerciser that: improves blood flow to the fingertips; provides optimum ease of self-application by the patient's uninjured hand to maximize independence in the home program; increases force directly at the distal interphalangeal joint to overcome restrictions inherent to an injured finger; centralizes a direction of pull to a single guide palmar to the proximal phalanx of each finger; and minimizes drag by limiting the number of guides per digit to operate more efficiently and effectively in assisting in early passive, early active assisted or early active tendon glide protocols.

It is a further object of the present invention to provide a hand splint that improves the rehabilitation of a hand over the prior art.

SUMMARY OF THE INVENTION

The present invention is a finger exercise device that includes a splint adapted to receive a hand and a portion of a forearm and a plurality of individual pulley arrangements adapted to be secured to a plurality of fingers of a patient. Each of the pulley arrangements includes a hook adapted to be glued to a fingernail of a patient's finger, a connector having a body defining a first hole where the hook passes through the first hole, an elastically extendable member having a first end and a second end where the first end is secured to the connector, a pulley strap having a body adapted to be releasably secured to a proximal phalanx of the finger where the pulley strap body defines a hole through which the elastically extendable member passes and an arrangement for securing the second end of the elastically extendable member to a portion of the splint. The splint includes a first segment adapted to support the forearm of the patient and a second segment adapted to support a portion of the patient's hand opposite a palm of the patient's hand. The first segment attaches to a first end of the second segment. The first segment extends along a first longitudinally extending line and the second segment extends along a second longitudinally extending line. An obtuse angle is defined at an intersection point of the first line and the second line. A third segment connects to a second end of the second segment and extends along a third longitudinally extending line. An obtuse angle is defined at an intersection point of the second line and the third line. The third segment is adapted to be positioned adjacent the fingers of the patient whereby when the finger exercise device is attached to a patient, the elastically extendable members apply tension forces to the patient's fingers when the fingers are moved from a bent position to a straight position.

DESCRIPTION OF THE PREFERRED EMBODIMENT

Figure 1:
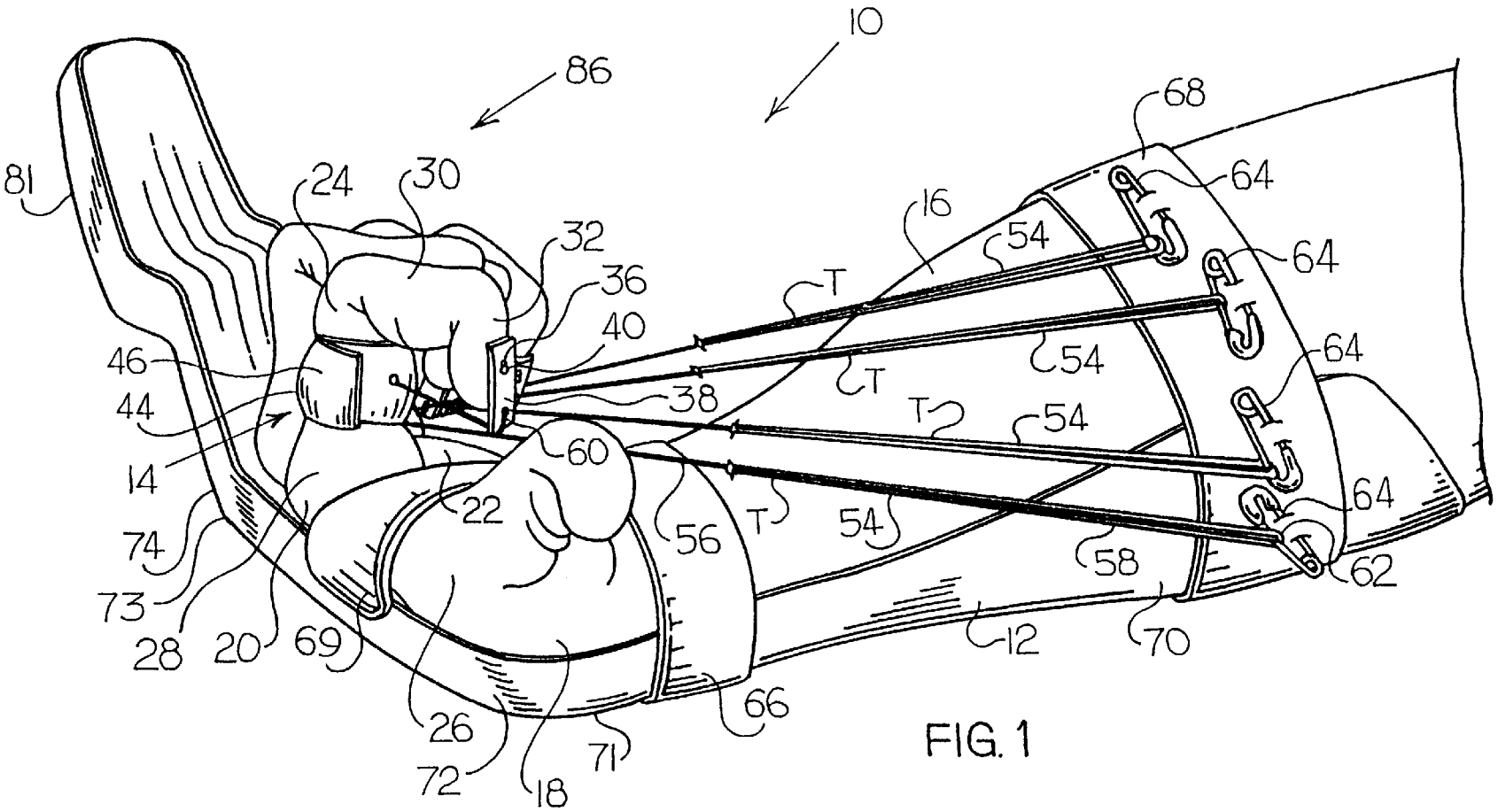
FIG. 1 is a side perspective view of a finger exercise device including a pulley strap traction guide and hand splint made in accordance with the present invention and attached to a left hand of a patient and the traction guide in a passive flexion or gentle active assisted flexion phase.
Figures 2, 5:
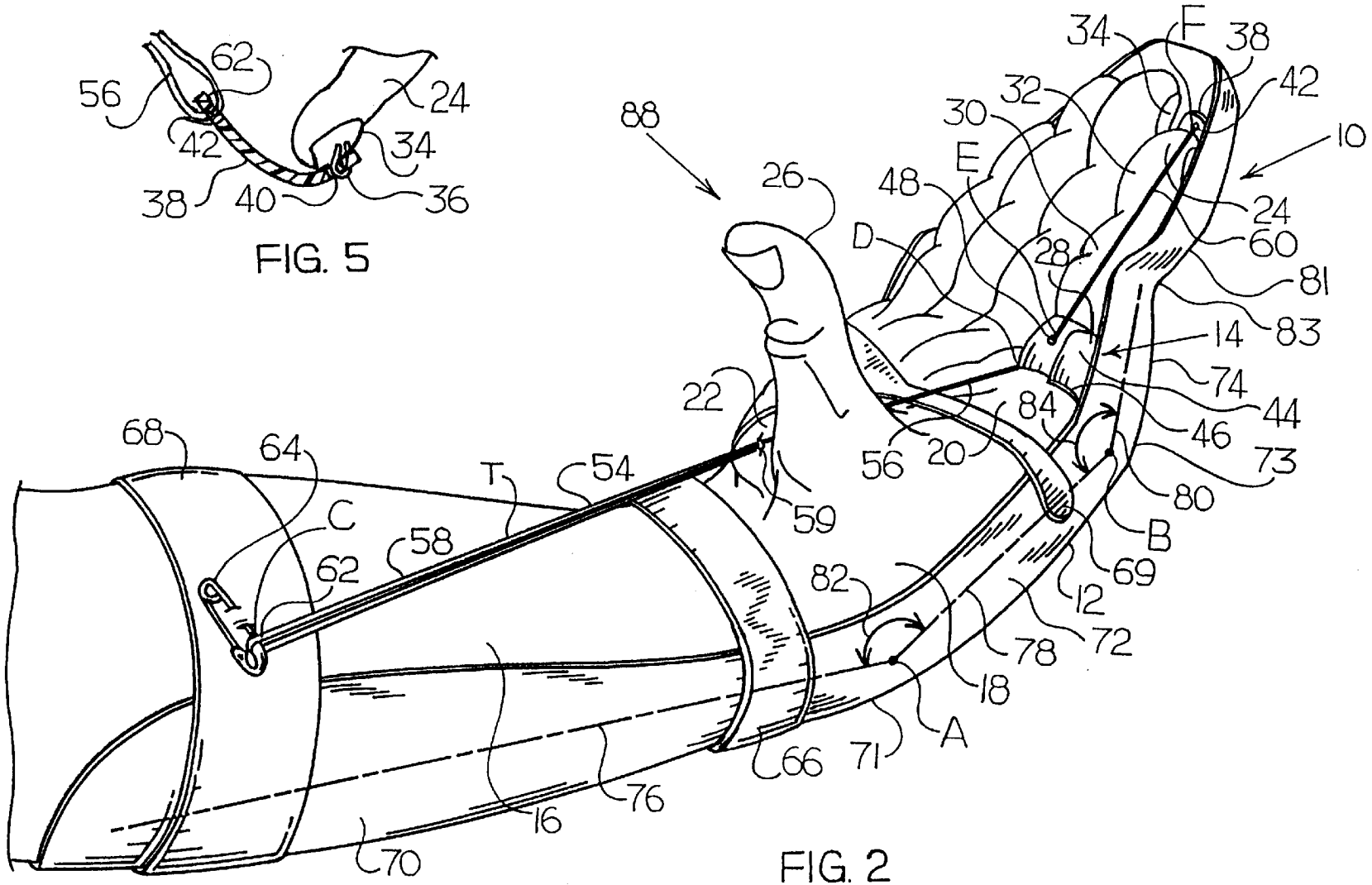
FIG. 2 is a side perspective view of a finger exercise device similar to the one shown in FIG. 1 with a patient's right hand and the pulley strap traction guide in an active extension phase where only one traction guide is attached to a finger.
FIG. 5 is a partial sectional side view of a portion of the pulley strap traction guide shown in FIG. 3 attached to a fingernail hook.
Figure 4:
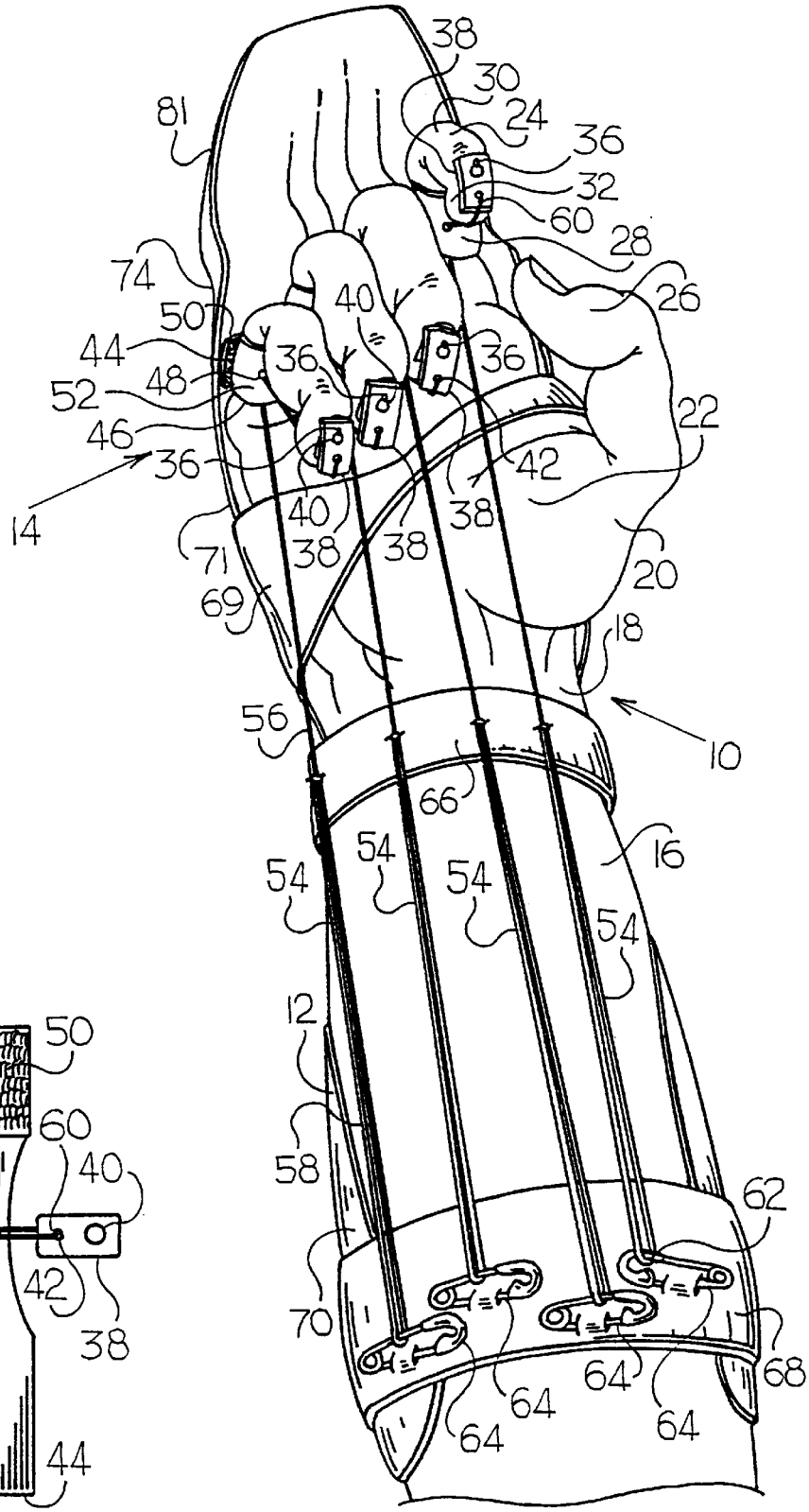
FIG. 4 is a top perspective view of the finger exercise device shown in FIG. 2.

FIGS. 1, 2 and 4 show a finger exercise device 10 made in accordance with the present invention. The finger exercise device 10 includes a splint 12 and a plurality of pulley strap traction guides 14. The splint 12 supports a patient's forearm 16, a wrist 18 and a hand 20. The hand 20 includes a palm 22, four fingers 24 and a thumb 26. Each finger 24 includes a proximal phalanx 28, a middle phalanx 30 and a distal phalanx 32. The patient's fingernail 34 is positioned on the distal phalanx 32. Fingernail hooks 36, such as dress hooks, that are well known in the art, are glued to each of the patient's fingernails 34 in a manner well known in the art. The fingernail hook 36 and a pulley strap traction guide 44 should be attached to each finger even though only one fingernail hook 36 and pulley strap traction guide 44 is shown in FIG. 2. Preferably, a plurality (four) of the pulley strap traction guides 14 is attached to the fingernails 34 through the fingernail hooks 36.

Figure 3:
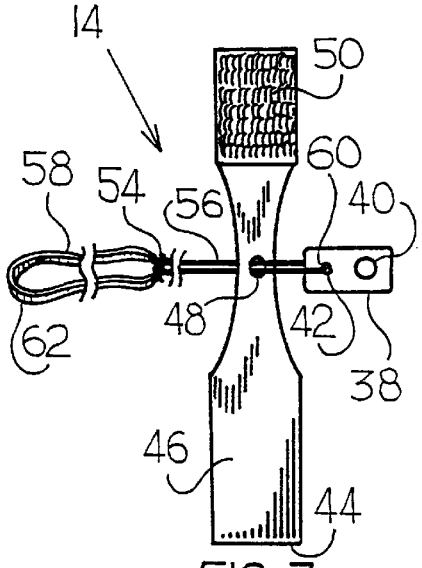
FIG. 3 is a top plan view of the pulley strap traction guide shown in FIGS. 1 and 2.

Each pulley strap traction guide 14 includes a connector having a connector body 38 defining a first hole 40 and a second hole 42. The connector body 38 can be made of leather. As shown in FIG. 5, a respective fingernail hook 36 passes through a respective first hole 40 of the connector body 38. Referring back to FIG. 3, a pulley strap 44 is removably attached to the proximal phalanx 28. The pulley strap 44 includes a butterfly-shaped or hourglass-shaped flexible body 46 defining a central hole 48. The hourglass-shaped body 46 can be made of nylon cloth. The hourglass shape avoids interfering with metacarpal phalangeal (MP) and proximal interphalangeal (P.I.P.) flexion. The hole is positioned at a distance of about one-third from a proximal edge to serve as a guide hole. Hook-type fasteners 50 are positioned at one end of the hourglass-shaped body 46 and loop-type fasteners 52 are positioned at an opposite end of the hourglass-shaped body 46. The hook-type fasteners 50 and the loop-type fasteners 52 can be VELCRO®-type fasteners. The pulley strap 44 is adapted to be wrapped around the proximal phalanx 28 so that the appropriate hook-type fasteners 50 and loop-type fasteners 52 come into contact with each other to support the pulley strap on the proximal phalanx 28.

An elastically extendable member 54 is provided and includes a nylon member or a nylon loop 56 attached to a rubber band 58. Preferably, the nylon loop 56 is tied to the rubber band 58 by a knot 59. Springs or other forms of tension can be provided in lieu of rubber bands 58. Preferably, the nylon loop 56 is made of fishing line and is four to six inches long. The nylon loop 56 permits easy slidability through the pulley strap 44. In the extended position, the rubber band 58 should not contact the pulley strap 44. A first end 60 of the elastically extendable member 54, which is defined on the nylon loop 56, is attached to the connector body 38 by passing the first end 60 retrograde through the central hole 48 and second hole 42 of the connector body 38 and fastened by a lanyard knot or in a lanyard style to the adjacent lower portion of the connector body 38.

Referring to FIGS. 1, 2 and 4, the splint 12 is secured to the forearm 16 through splint straps 66 and 68. The splint straps can be made of an elastic material, such as neoprene VELFOAM and/or flexible material that can be placed over the hand 20 and onto the forearm 16 and secured to the splint 12 with VELCRO®-type hooks and loop fasteners. A plurality of pins 64, such as safety pins, are secured to the splint strap 68. Respective second ends 62 of the elastically extendable members 54 are secured to respective pins 64. Other arrangements, such as hooks or other types of fasteners, can be used in lieu of pins 64 to connect the second ends 62 to the splint strap 68. The pulley strap traction guide 14, fingernail hooks 36 and pins 64 identifies a finger pulley arrangement.

A flexible palmar bar 69 is secured to the splint 12 adjacent the palm 22 of the patient. The palmar bar 69 is adapted to rest against the palm 22 of the patient's hand 20. The palmar bar 69 has one end fixedly attached to the splint 12 and an opposite end having a VELCRO®-type hook fastener at the opposite end. The VELCRO®-type loop members or fastener is attached to the splint 12 so that the palmar bar 69 is removably securable to the splint 12 at the VELCRO®-type fastener end.

Preferably, the splint 12 is rigid and made of a plastic material, such as thermoplastic materials and includes a first segment 70 integrally attached to a first end 71 of a second segment 72. A third segment 74 is integrally attached to a second end 73 of the second segment 72. The first segment 70 is adapted to support the forearm 16 of a patient. The second segment 72 is adapted to support the portion of the patient's hand which is opposite of the palm 22 and the third segment 74 is adapted to support and be positioned adjacent to the fingers 24. As can be seen in FIG. 2, the first segment 70 extends along a longitudinally extending line 76. The second segment 72 extends along a longitudinally extending line 78. The third segment 74 extends along a longitudinally extending line 80. A fourth segment 81 is attached to a distal end 83 of the third segment 74 and is slightly offset from third segment 74 and extends along a line that is approximately parallel to longitudinally extending line 80 and is adapted to conform to the fully hyper-extended or reversed, arched nature of the fully extended fingers. Alternatively, fourth segment 81 can be eliminated and the third segment 74 can extend the full length of the fingers in lieu of fourth segment 81. Lines 76 and 78 intersect at point A and define an obtuse angle 82 and lines 78 and 80 intersect at point B and define an obtuse angle 84. Obtuse angles 82 and 84 are approximately 150°, but can vary on a case-by-case basis, say for example, between ranges of 140° to 160°.

The finger exercise device 10 is secured to the patient in the following order. First, fingernail hooks 36 are glued to respective fingernails 34. The pulley straps 44 are secured to the fingers 24. The nylon loops 56 are passed through respective holes 48 and secured to the respective connector bodies 38 and the rubber bands 58. The splint 12 is then secured to the patient by the splint straps 66 and 68 and the palmar bar 69 so that the elastically extendable members 54 are free to move and are positioned above the splint straps 66 and 68 and the palmar bar 69. The pins 64 are placed on opposite sides of the splint strap to disperse the force of traction to the four fingers. Ends of the rubber bands 58 are secured to the pins 64 and the connector bodies 38 are secured to the fingernail hooks 36 so as to place a traction or tension force to the patient's fingers when the fingers are moved from a bent position, as shown in FIGS. 1 and 4, to a straightened position as shown in FIG. 2, which causes the rubber band 58 to elastically expand. Preferably, all of the fingers should have tractions to place muscles in similar tension. As can be seen, the bending and straightening of a finger causes the elastically extendable member 54 to elastically extend and contract via the rubber band 58. The force applied to the finger increases the more the rubber band 58 is expanded. Preferably, traction is applied to the fingers even in the bent position when the rubber bands 58 are least extended.

The present invention provides a direct, unimpeded line of traction T between points C and D along the palmar aspect of the fingers between the pins 64 and the pulley straps 44 and closely approximates the action of the flexor tendons upon the fingers. Another traction line is defined between points E and F between the pulley straps 44 and the connector bodies 38. The device described in U.S. Pat. No. 5,413,554 does not achieve this due to the guides. Further, the present invention has an increased "lever arm effect" on the fingers because the nylon loop 56 is attached to the fingernail hook 36 at the tip of the finger as opposed to a strap on the distal phalanx and the elastically extendable member 54 extends along one line as opposed to two lines as shown in U.S. Pat. No. 5,413,554. The segments 72 and 74 define a dorsal extension block splint to maintain preferably a minimum of 20° wrist palmar flexion and preferably 50°–70° MP flexion. Further, traction is applied to each finger along one line as opposed to two lines as disclosed in U.S. Pat. No. 5,413,554. The present splint 12, which modifies a standard splint that normally encourages flexion contractures at the P.I.P., allows for hyperextension at the P.I.P. joints which is not possible in the device shown in U.S. Pat. No. 5,413,554. The present invention also overcomes the possibility of tissue damage by the use of fingernail hooks 36 as opposed to the adjustable straps disclosed in U.S. Pat. No. 5,413,554. An elastic strap (not shown), such as an ACE bandage, can also be attached lightly at the level of the fingers to promote full finger extension at night if desired.

The finger exercise device 10 can be used by the patient at home and exercise instructions are dependent on a physician's preference, including whether to apply an elastic ACE wrap or bandage for finger extension at night when traction is disconnected. An important aspect of the invention is that the elastically extendable members 54 do not pass through guides between each pin 64 and each pulley strap 44. Further, it is important that the patient's hand be positioned in the splint 12 so that the forearm extends along line 76, the palm extends along line 78 and the fingers in the extended position extend along line 74 so that the exercise of the hand between the passive flexion phase 86 and the active flexion phase 88 results in a movement as shown in FIGS. 1, 2 and 4. Hence, the present invention fulfills the objectives of the present invention.

The present invention also achieves a necessary restriction of wrist and metacarpal phalangeal extension to the degree that tensile stress is minimized at tendon repair site(s) but promotes full and unobstructed extension at the proximal interphalangeal joint.

Having described the presently preferred embodiment of the invention, it is to be understood that it may otherwise be embodied within the scope of the appended claims.

I claim:

1. A finger exercise device, comprising:

a splint adapted to receive a hand and a portion of a forearm; and a plurality of individual finger pulley arrangements adapted to be secured to a plurality of fingers of a patient, each of said finger pulley arrangements, comprising:

a hook adapted to be glued to a fingernail of a patient's finger;

a connector having a connector body defining a first hole, said hook passing through said first hole;

an elastically extendable member having a first end and a second end, said first end secured to said connector;

a pulley strap having a pulley strap body adapted to be releasably secured to a proximal phalanx of the finger, said pulley strap body defining a hole through which said elastically extendable member passes; and securing means for securing said second end of said elastically extendable member to a portion of said splint adapted to support the forearm of a patient, said splint comprising a first segment adapted to support the forearm of the patient, a second segment adapted to support a portion of the patient's hand opposite a palm of the patient's hand, said first segment attached to a first end of said second segment, said first segment extending along a first longitudinally extending line and said second segment extending along a second longitudinally extending line, an obtuse angle being defined at an intersection point of the first line and the second line, and a third segment connected to a second end of said second segment extending along a third longitudinally extending line, an obtuse angle being defined at an intersection point of the second line and the third line, said third segment adapted to be positioned adjacent the fingers of a patient whereby when said finger exercise device is attached to a patient, said elastically extendable members apply tension forces to the patient's fingers when the fingers are moved from bent positions to straightened positions.

2. A finger exercise device as claimed in claim 1, wherein each of said connector bodies defines a second hole through which said elastically extendable member passes.

3. A finger exercise device as claimed in claim 1, wherein each of said elastically extendable members comprises a rubber member.

4. A finger exercise device as claimed in claim 3, wherein each of said elastically extendable members further comprises a nylon member secured to said rubber member.

5. A finger exercise device as claimed in claim 4, wherein each of said rubber members is a rubber band.

6. A finger exercise device as claimed in claim 1, further comprising a flexible palmar bar secured to said splint and adapted to rest against a palm of the patient's hand.

7. A finger exercise device as claimed in claim 1, wherein each of said elastically extendable members travels unimpeded from said securing means to said respective one of said pulley straps.

8. A finger exercise device as claimed in claim 1, wherein each of said connector bodies is made of leather.

9. A finger exercise device as claimed in claim 1, wherein said splint is rigid.

10. A finger exercise device as claimed in claim 1, further comprising means for securing said splint to a patient's arm.

11. A finger exercise device as claimed in claim 10, wherein said means for securing said splint to a patient's arm comprises a flexible splint strap.

12. A finger exercise device as claimed in claim 10, wherein said means for securing said splint to a patient's arm comprises two spaced apart flexible splint straps.

13. A finger exercise device as claimed in claim 1, wherein said securing means comprises a plurality of pins, wherein each of said elastically extendable members is secured to a respective one of said pins.

* * * * *